US010486188B2

(12) United States Patent
Ludwig et al.

(10) Patent No.: US 10,486,188 B2
(45) Date of Patent: Nov. 26, 2019

(54) DISCHARGE DEVICE FOR A FILM PACKAGE, FILM PACKAGE AND ASSEMBLY FORMED BY A DISCHARGE DEVICE AND A FILM PACKAGE

(71) Applicant: HILTI AKTIENGESELLSCHAFT, Schaan (LI)

(72) Inventors: Wolfgang Ludwig, Zaisertshofen (DE); Matthias Wolf, Gilching (DE); Friedemann Setzer, Schwabmuenchen (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 16/067,641

(22) PCT Filed: Jan. 11, 2017

(86) PCT No.: PCT/EP2017/050437
§ 371 (c)(1),
(2) Date: Jul. 2, 2018

(87) PCT Pub. No.: WO2017/125288
PCT Pub. Date: Jul. 27, 2017

(65) Prior Publication Data

US 2019/0015865 A1 Jan. 17, 2019

(30) Foreign Application Priority Data

Jan. 20, 2016 (EP) ..... 16152017

(51) Int. Cl.
*B05C 17/005* (2006.01)
*B05C 17/01* (2006.01)

(52) U.S. Cl.
CPC .. *B05C 17/00576* (2013.01); *B05C 17/00583* (2013.01); *B05C 17/01* (2013.01); *B05C 17/00553* (2013.01)

(58) Field of Classification Search
CPC ..... B05C 17/00576; B05C 17/01; B05C 17/00583; B05C 17/00553
See application file for complete search history.

(56) References Cited

U.S. PATENT DOCUMENTS 5,301,839 A * 4/1994 Eierle ..... B05C 17/00576 222/105
5,332,122 A * 7/1994 Herold ..... B05C 17/00509 222/105

(Continued)

FOREIGN PATENT DOCUMENTS

DE 43 16 807 11/1994
DE 103 51 828 7/2005

(Continued)

OTHER PUBLICATIONS

International Search Report mailed in PCT/EP2017/050437 dated Mar. 27, 2017, with English translation.

(Continued)

*Primary Examiner* — Frederick C Nicolas
(74) *Attorney, Agent, or Firm* — Grüneberg and Myers PLLC

(57) ABSTRACT

A discharge device can be used in a film package for storage of a one-component or multicomponent mass. The discharge device includes at least one receptacle for insertion of a film bag of the film package, and at least one piston disposed displaceably in the receptacle for discharging the mass from the film bag. The piston has a receiving groove for an accumulated film section of the at least partly emptied film bag.

18 Claims, 3 Drawing Sheets

(56) References Cited

U.S. PATENT DOCUMENTS 5,370,282 A * 12/1994 Sedlmeier ..... B05C 17/01 222/391
5,449,096 A * 9/1995 Sedlmeier ..... B05C 17/00576 222/386
5,697,524 A * 12/1997 Sedlmeier ..... B01F 13/002 222/105
5,909,830 A * 6/1999 Bates ..... B05C 17/0103 222/327
6,129,244 A * 10/2000 Horth ..... B05C 17/00516 222/105
6,158,621 A * 12/2000 Keller ..... B05C 17/00583 222/105
6,206,244 B1 * 3/2001 Muhlbauer ..... B05C 17/00576 222/105
6,299,022 B1 * 10/2001 Bublewitz ..... B05C 17/00506 222/105
6,352,177 B1 * 3/2002 Bublewitz ..... A61C 9/0026 222/137
6,644,509 B1 * 11/2003 Bublewitz ..... B05C 17/00506 222/105
7,510,546 B2 * 3/2009 Baessler ..... B05C 17/00583 222/139
7,690,530 B2 * 4/2010 Schneider ..... B05C 17/00513 222/105
7,775,399 B2 * 8/2010 Wood ..... B05C 17/00513 222/105
8,313,006 B2 * 11/2012 Willner ..... B05C 17/00553 222/137
9,597,706 B2 * 3/2017 Burns ..... B05C 17/00583
2010/0027918 A1 2/2010 Willner et al.
2015/0114986 A1 * 4/2015 Ngu ..... B05C 17/00553 222/94

FOREIGN PATENT DOCUMENTS

DE 10 2008 040 738 1/2010
WO 2006/121978 11/2006

OTHER PUBLICATIONS

Written Opinion of the International Searching Authority mailed in PCT/EP2017/050437 dated Mar. 27, 2017.

* cited by examiner

DISCHARGE DEVICE FOR A FILM PACKAGE, FILM PACKAGE AND ASSEMBLY FORMED BY A DISCHARGE DEVICE AND A FILM PACKAGE

This application is a National stage entry under § 371 of International Application No. PCT/EP2017/050437, filed on Jan. 11,2017, and claims priority to European Patent Application No. 1652017.6, on Jan. 20, 2016.

FIELD OF THE INVENTION

The invention relates to a discharge device for a film package for storage of a one-component or multicomponent mass, with at least one receptacle for insertion of a film bag of the film package as well as at least one piston disposed displaceably in the receptacle for discharging the mass from the film bag. According to a further aspect, the invention relates to a film package for storage of a one-component or multicomponent mass, with at least one elongated film bag designed to be inherently non-rigid and at least one inherently rigid carrier part, on which an axial end of the film bag is fastened. Furthermore, the invention relates to an assembly comprising such a discharge device and such a film package.

BACKGROUND OF THE INVENTION

Film packs have proved useful in the past as packaging for chemical masses, such as, for example, mortar, foam, plugging or sealing masses that consist of one or more components. In particular, compared with cartridges, they are characterized by more cost-effective and simpler manufacturing as well as by a smaller proportion of material to be disposed of after use.

To apply the mass, the film package is usually pushed into a receptacle of a discharge device, for example a dispenser. Via a discharging mechanism, possibly in the form of a displaceable piston, the one-component or multicomponent mass is discharged through an outlet opening in the carrier part and then (at least in the case of a multicomponent mass) is passed for better mixing through a mixer attachment having a mixer element.

DE 10 2008 040 738 A1 discloses a film package of the type mentioned in the introduction, which has two film bags disposed laterally alongside one another, is able to receive two-component and multicomponent masses and is suitable for being inserted into a discharge device having two receptacles disposed alongside one another.

A disadvantage of the known configuration is that the film becomes crumpled during emptying of the film package by means of the piston. This results in a cylindrical accumulation of film ahead of the piston, whereby a volume that cannot be emptied is formed between the bag end and the carrier part.

SUMMARY OF THE INVENTION

It is therefore the object of the invention to further develop the known system to the effect that complete emptying of the residues is possible.

According to a first aspect of the invention, it is provided for this purpose, in a discharge device of the type mentioned in the introduction, that the piston has a receiving groove for accumulated film sections of the at least partly emptied, inherently non-rigid film bag. Such a special piston therefore has available a kind of receiving space for the accumulated sections of the already partly emptied film bag, so that these do not accumulate undesirably ahead of the piston and thus form a region with walls greatly reinforced by folding, which would prevent emptying of the mass contained therein. In the inventive discharge device, the accumulated film sections, which form folds, for example, are collected together in the receiving groove of the piston, so that complete emptying of the residues of the film bag is possible. The accumulated film sections do not have to have any particular and any regular geometry. They are caused by any kind of gathering together. The term accumulated film sections therefore encompasses but is not limited to folded, crumpled, rolled and similarly formed film sections, although in particular the film is folded in this region.

With the inventive discharge device, it is possible to empty conventional film packs known from the prior art completely.

In a preferred embodiment, the receiving groove is a circumferential annular groove, which is provided in a shell region of the piston facing an inner circumferential wall of the receptacle and starts from an end face of the piston bounding the receptacle. Precisely at the rim region of the film bag adjacent to the inner circumferential wall of the receptacle is where most folds form during displacement of the piston in the receptacle. Such an annular groove, which is provided in the rim region of the end face of the piston facing the film bag, is therefore optimally suitable for receiving the accumulated, especially folded film sections.

Advantageously, the height and/or width of the receiving groove and thus its volume is selected to be so large that it is able to receive the accumulated, especially folded film sections of the completely emptied film bag. The volume is to be so dimensioned in the discharged condition that no free mortar volume is still present. Thus the volume (groove volume) should be selected such that it is neither too small nor too large and that it corresponds to the dimensioning of the film. In this way, complete emptying of the film bag is ensured in the end position of the piston, since all folds being formed are received by the receiving groove and thus no undesired accumulation of film can take place ahead of the piston.

According to a second aspect of the invention, the object stated hereinabove is likewise solved by a film package of the type mentioned in the introduction, in which the at least one carrier part is provided with a receiving groove for accumulated, especially folded film sections of the at least partly emptied film bag. The folds formed during discharging of the film bag "disappear" in the receiving groove of the carrier part. Thus a receiving volume that receives the accumulated, especially folded film is provided in the carrier part, and the remaining carrier part is preferably so constructed that, together with the end of the film bag, complete emptying of the residues is possible. In this connection, the inventive film package may be used in particular in a conventional discharge device according to the prior art.

According to a preferred embodiment, the receiving groove is a circumferential annular groove, which is provided in a rim region of the carrier part facing the film bag and starts from an end face of the carrier part facing the inside of the film bag. It is precisely in the rim region of the film bag where a accumulation of folds occurs during discharging, which is why an annular groove disposed in this region is particularly suitable for preventing undesired accumulation of film ahead of the piston of the discharge device.

Preferably, the carrier part projects at least partly into the film bag and in particular is joined thereto via a joint disposed on the outside of the carrier part. This joint is preferably a circumferential "seam" disposed on the outside of the carrier part. Such a film package is characterized by simple manufacturing, since the joint(s) is/are accessible from the outside.

In a preferred configuration, the at least one carrier part is disposed on an outlet end of the film bag. Since an inherently rigid head part is usually provided in any case at the outlet end for easier manipulability, costs and resources can be saved in this configuration due to the relatively small use of materials. Moreover, an excessive volume of wastes after emptying is avoided.

In particular, the at least one carrier part has an outlet opening for the mass stored in the film bag. This is advantageously disposed centrally in the carrier part and extends over its entire height. A mixer attachment, for example, may be screwed directly onto such an outlet opening.

Alternatively or additionally, the at least one carrier part may be disposed at an end of the film bag facing a piston of a discharge device. This is particularly favorable for receiving the accumulated, especially folded film sections.

In an improvement of the invention, a carrier part is provided with a receiving groove at both axial ends of the elongated film bag.

Preferably, the height and/or width of the at least one receiving groove and thus its volume is selected to be so large that it is able to receive the accumulated, especially folded film sections of the completely emptied film bag. In this way, complete emptying of the residues is made reliably possible. In the case of two carrier parts at the head and at the bottom end of the bag, the two grooves of the carrier parts are naturally able to cooperate appropriately here to provide a suitable volume.

According to a third aspect of the invention, the object stated hereinabove is solved by an assembly of the type mentioned in the introduction, which has an inventive discharge device as well as an inventive film package, wherein at least one carrier part is disposed on an outlet end of the film bag. In the inventive assembly, therefore, a discharge device having a piston, which is provided with a receiving groove for the accumulated, especially folded film sections, advantageously cooperates with a film package having a carrier part, which is disposed at the outlet end and which likewise is equipped with a receiving groove for accumulated, especially folded film sections. Thereby a particularly large receiving space is obtained for the folds formed during displacement of the piston.

Preferably, these receiving grooves on the piston and on the carrier part are so matched to one another that they are able able to receive the accumulated, especially folded film sections of the completely emptied film bag. Thereby complete emptying of the film bag is ensured in the end position of the piston.

Of course, the film package may also be provided with two or more film bags disposed alongside one another for components of a multicomponent mass stored separately from one another. The associated discharge device then has correspondingly more receptacles for the film bags.

BRIEF DESCRIPTION OF THE DRAWING

Further features and advantages will become obvious from the description hereinafter of two preferred embodiments on the basis of the attached drawings, wherein.

DETAILED DESCRIPTION

Figure 1:
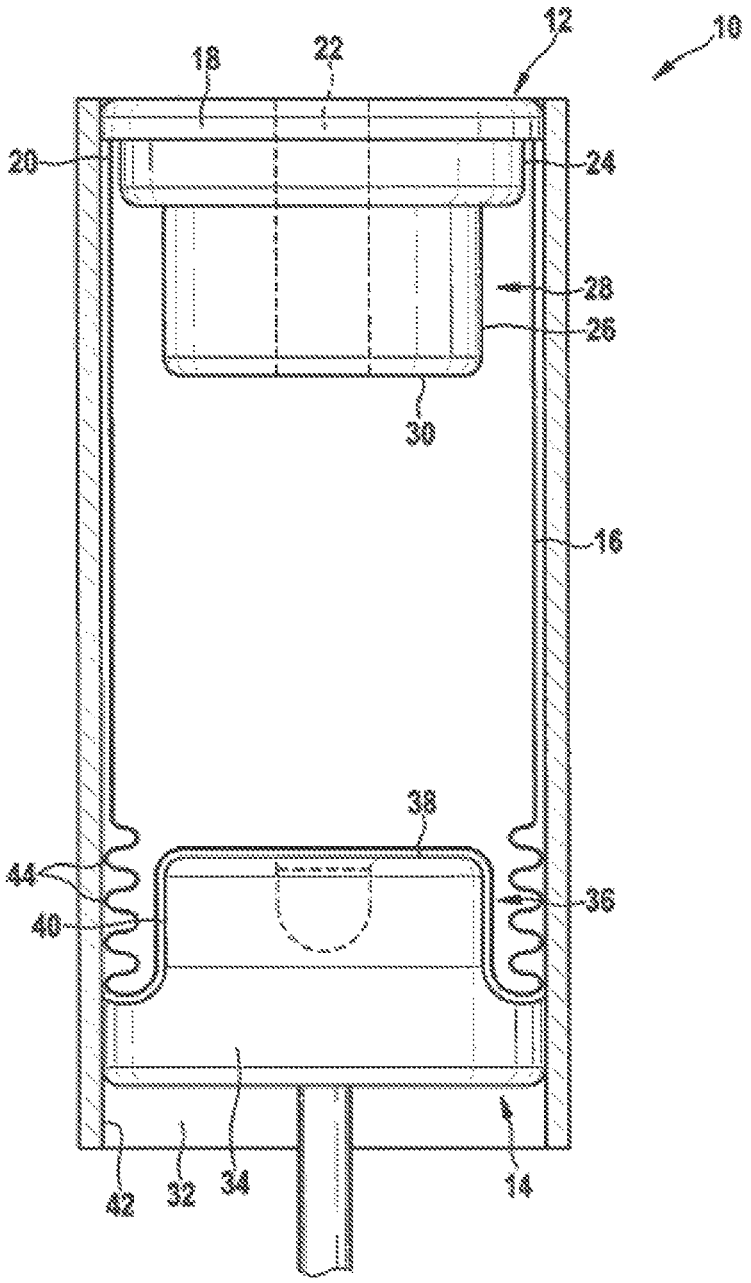
FIG. 1 shows a side view of an inventive assembly with a partly emptied film bag.
Figure 2:
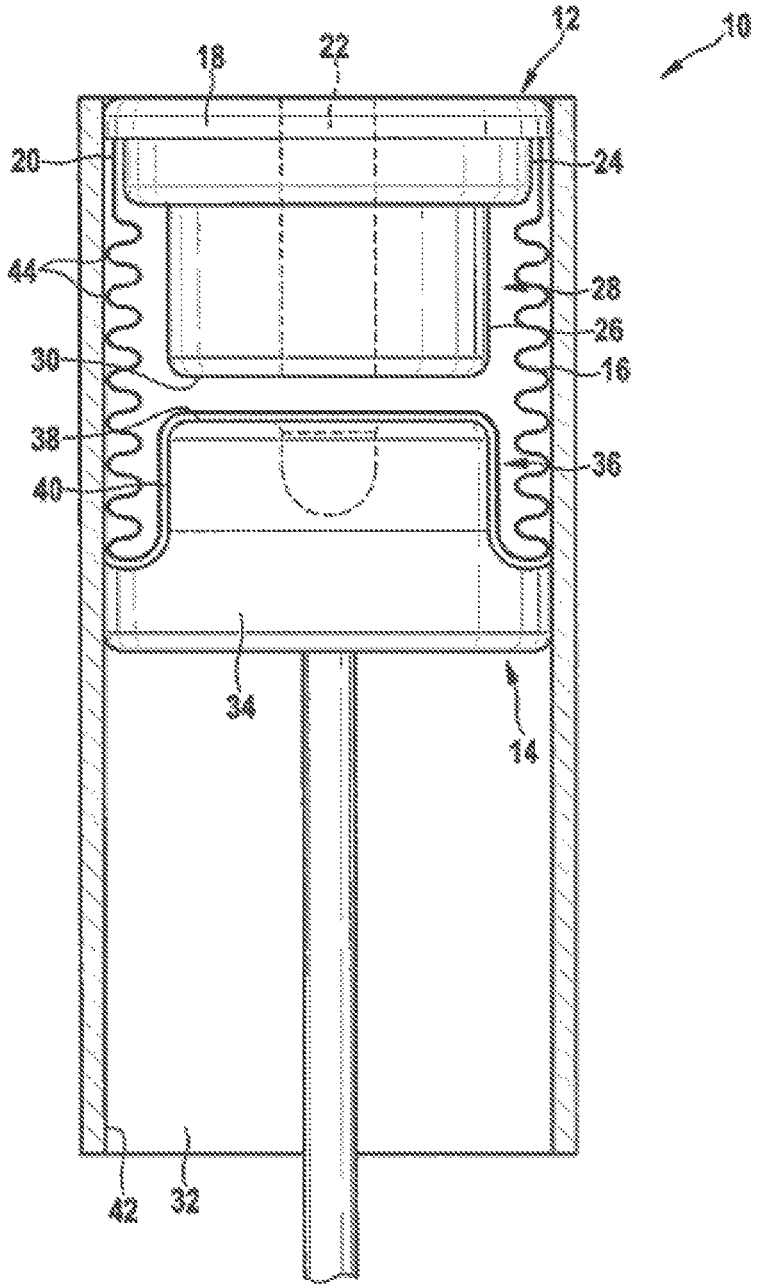
FIG. 2 shows a side view of the assembly from FIG. 1 with completely emptied film bag.

FIGS. 1 and 2 show an inventive assembly 10, which is provided with a film package 12 for storing a chemical mass, such as, for example, a sealing mass, a mortar, a coating mass, a dye, a foam precursor, an adhesive or a lubricant. Furthermore, assembly 10 comprises a discharge device 14 for film package 12.

Film package 12 is provided with a filled film bag 16, which is used for storage of one or more components of the said mass. Film bag 16 is elongated and (without contents) is designed to be inherently non-rigid. Furthermore, film package 12 comprises an inherently rigid carrier part 18, on which one axial end, here the outlet end 20, of film bag 16 is fixed. Carrier part 18 is provided with an outlet opening 22 for the mass stored in film bag 16, wherein outlet opening 22 is disposed centrally in carrier part 18 and extends over its entire height. A mixer attachment, which is not shown in the figures, may be coupled with outlet opening 22.

Via a circumferential joint 24 disposed on the outside of carrier part 18, carrier part 18 is joined to tubular film bag 16 and projects at least partly into film bag 16.

Moreover, carrier part 18 is provided in a rim region 26 facing film bag 16 with a receiving groove 28, which is formed as a circumferential annular groove. This receiving groove 28 starts from the end face 30 of carrier part 18 facing the inside of film bag 16 and extends over approximately two thirds of its height.

For the purpose of emptying, film package 12 is inserted in a receptacle 32 of discharge device 14, and a piston 34 is disposed displaceably in receptacle 32.

Piston 34 is likewise provided with a circumferential groove 36, which starts from an end face 38 of piston 34 that bounds receptacle 32 and faces film bag 16, and which is disposed in a shell region 40 of piston 34 that faces an inner circumferential wall 42 of receptacle 32. Receiving groove 36 is also formed as a circumferential annular groove.

Both receiving grooves 28, 36 are used for receiving accumulated film sections 44, which are formed during discharging of film bag 16 by displacement of piston 34 in receptacle 32 while film bag 16 is still being emptied. FIG. 1 shows the partly emptied state of film bag 16.

Therein the two receiving grooves 36 and 28 of piston 34 and of carrier part 18 respectively are constructed to be almost equally broad and, just as the respective heights of receiving grooves 28, 36, are selected and matched to one another in such a way that they are able to receive the accumulated film sections 44 of the completely emptied film bag 16, so that complete emptying of film bag 16 is achieved in the end position of piston 34 shown in FIG. 2.

Alternatively to the shown configuration, in which both discharge device 14 and film package 12 are provided with a receiving groove 36 and 28 respectively for accumulated film sections 44, discharge device 14 naturally can also be used with a conventional film package, just as film package 12 may also be used in a conventional discharge device. The decisive aspect is then merely that the width or height of what is then the single receiving groove is selected such that it is able to receive the accumulated film sections of the entire completely emptied film bag.

Figure 3:
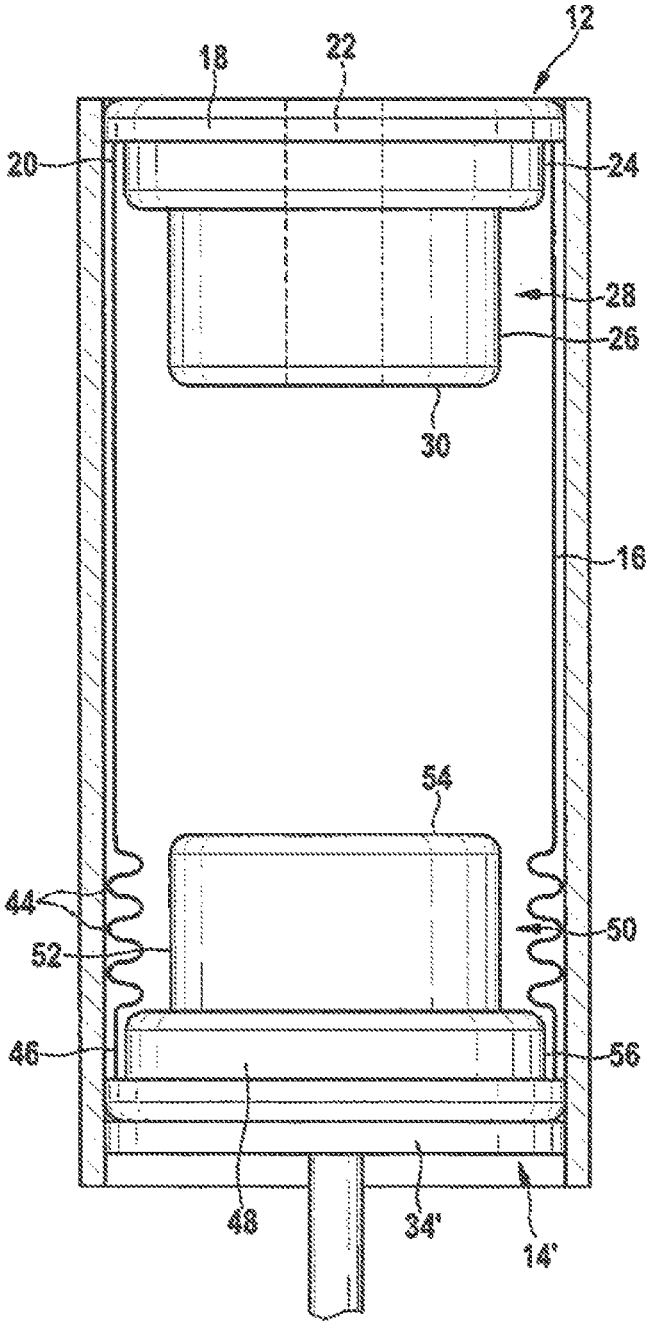
FIG. 3 shows a side view of a film package inserted in a discharge device according to a further embodiment of the invention with partly emptied film bag.

FIG. 3 shows an alternative configuration of an inventive film package 12, wherein, hereinafter, like parts are denoted by like reference symbols and only the differences relative to the embodiment described in the foregoing are discussed.

Film package 12 according to FIG. 3 is used in a conventional discharge device 14', which is provided with a simple dish-like piston 34' without receiving groove. This discharge device 14' is known in itself, and so it will not be discussed further here.

Film package 12 corresponds in its upper region in FIG. 3 to that of FIGS. 1 and 2 and is additionally provided at end 46 of film bag 16 facing piston 34' with a further carrier part 48. This also has available a receiving groove 50, which is provided in a rim region 52 of the carrier part facing film bag 16 and starts from an end face 54 of carrier part 48 facing the inside of film bag 16. Carrier part 48 also projects partly into film bag 16 and is joined thereto via a joint 56 disposed on the outside of carrier part 48.

In film package 12 according to FIG. 3, therefore, a carrier part 18 or 48 is provided at the two axial ends 20, 46 of elongated film bag 16 with a receiving groove 28 or 50 respectively. Therein especially the heights of the two receiving grooves 28, 50 are matched to one another in such a way that they are able to receive the accumulated film sections 44 of the completely emptied film bag 16 (not shown), so that once again complete emptying of the film bag 16 is achieved in an end position of piston 34'.

The invention claimed is:

1. A discharge device for a film package for storage of a one-component or multicomponent mass, the discharge device comprising:

a first receiving groove, a second receiving groove, at least one receptacle for insertion of a film bag of the film package, and at least one piston disposed displaceably in the receptacle for discharging the mass from the film bag, wherein the first receiving groove is between an inner wall of the at least one receptacle and the piston and wherein the second receiving groove is between the inner wall of the at least one receptacle and a surface different from the at least one piston, the surface at a discharge end of the at least one receptacle and the first receiving groove aligned with the second receiving groove to receive an accumulated film section of the at least partly emptied film bag when the at least one piston moves to discharge the mass from the film bag.

2. The discharge device according to claim 1, wherein the first receiving groove is a circumferential annular groove, which is provided in a shell region of the piston facing the inner wall of the receptacle and starts from an end face of the piston bounding the receptacle, the inner wall being an inner circumferential wall of the receptacle.

3. The discharge device according to claim 1, wherein at least one of a height and a width of the first receiving groove is selected to be so large that the first receiving groove is able to receive the accumulated film sections of the completely emptied film bag.

4. An assembly comprising a discharge device according to claim 1, and a film package for storage of a one-component or multicomponent mass, the film package comprising:

at least one elongated film bag designed to be inherently non-rigid, at least one inherently rigid carrier part, on which one axial end of the film bag is fixed, wherein the surface corresponds to a surface of the at least one carrier part and wherein the at least one carrier part is disposed on an outlet end of the film bag.

5. The assembly according to claim 4, wherein the first and second receiving grooves are matched to one another such that the first and second receiving grooves are able to receive the accumulated film sections of the film bag completely emptied.

6. The discharge device according to claim 1, wherein the surface is a surface of a carrier part coupled to the discharge end of the at least one receptacle to discharge the mass.

7. film package for storage of a one-component or multicomponent mass, the film package comprising:

at least one elongated film bag designed to be inherently non-rigid, and at least one inherently rigid carrier part, on which one axial outlet end of the film bag is fixed, wherein the at least one inherently rigid carrier part comprises a receiving groove for accumulated film sections of the at least one elongated film bag in at least partly emptied state and is provided with an outlet opening for the mass stored in the film bag.

8. The film package according to claim 7, wherein the receiving groove is a circumferential annular groove, which is present in a rim region of the carrier part facing the film bag and starts from an end face of the carrier part facing the inside of the film bag.

9. The film package according to claim 7, wherein the at least one inherently rigid carrier part projects at least partly into the film bag and is joined thereto via a joint disposed on the outside of the at least one inherently rigid carrier part.

10. The film package according to claim 7, wherein the at least one inherently rigid carrier part is disposed on an end of the film bag facing a piston of a discharge device.

11. The film package according to claim 7, wherein the at least one inherently rigid carrier part comprises a receiving groove at both axial ends of the elongated film bag.

12. The film package according to claim 7, wherein at least one of a height and a width of the at least one receiving groove is selected to be so large that the at least one receiving groove is able to receive the accumulated film sections of the film bag completely emptied.

13. A discharge device, comprising:

at least one receptacle to support a film bag comprising a mass;

a piston to apply a force against the film bag to discharge the mass, a first area between an inner wall of the at least one receptacle and the piston, and a second area between the inner wall of the at least one receptacle and a carrier which is to be joined to a discharge end of the at least one receptacle, the first area and the second area to receive accumulated sections of the film bag when the piston applies the force.

14. The discharge device according to claim 13, wherein:

the first area includes a first receiving groove, and the second area includes a second receiving groove.

15. The discharge device according to claim 14, wherein:

the first receiving groove is spaced from the second receiving groove when the piston is at a first position, and the first receiving groove is coupled to the second receiving groove when the piston is at a second position, wherein the piston is closer to the discharge end of the at least one receptacle in the second position than when the piston is in the first position.

16. The discharge device according to claim 15, wherein when the piston is in the first position:

the first receiving groove includes the accumulated sections of the film bag, and the second receiving groove is to separate the inner wall of the at least one receptacle from the carrier when the carrier is at the discharge end of the at least one receptacle.

17. The discharge device according to claim 15, wherein the first receiving groove and the second receiving groove include the accumulated sections of the film bag when the piston is in the second position.

18. The discharge device according to claim 13, wherein the carrier includes an opening to discharge the mass when the piston applies the force.

* * * * *